US007262737B2

(12) United States Patent
Zarnowitz et al.

(10) Patent No.: US 7,262,737 B2
(45) Date of Patent: Aug. 28, 2007

(54) EXTENDABLE ANTENNA ARCHITECTURE

(75) Inventors: Arthur Zarnowitz, San Jose, CA (US); Weiping Dou, Milpitas, CA (US); Chrome Cebe, San Jose, CA (US)

(73) Assignee: Palm, Inc., Sunnyvale, CA (US)

( * ) Notice: Subject to any disclaimer, the term of this patent is extended or adjusted under 35 U.S.C. 154(b) by 0 days.

(21) Appl. No.: 11/204,280

(22) Filed: Aug. 15, 2005

(65) Prior Publication Data

US 2007/0035454 A1 Feb. 15, 2007

(51) Int. Cl.
*H01Q 1/24* (2006.01)

(52) U.S. Cl. ..... 343/702; 343/901; 455/575.7

(58) Field of Classification Search ..... 343/702, 343/700 MS, 900, 901; 455/558, 575.7
See application file for complete search history.

(56) References Cited

U.S. PATENT DOCUMENTS 5,335,367 A * 8/1994 Adachi et al. ..... 455/575.7
5,534,878 A * 7/1996 Johnson ..... 343/702
5,918,163 A * 6/1999 Rossi ..... 455/558
6,392,604 B1 * 5/2002 Bohannan ..... 343/702
6,545,643 B1 * 4/2003 Sward et al. ..... 343/702
6,618,013 B1 9/2003 Aldous
6,752,320 B1 * 6/2004 Herranen ..... 235/492
2004/0185808 A1 * 9/2004 Chow ..... 455/127.2

FOREIGN PATENT DOCUMENTS

| | | | |
|---|---|---|---|
| EP | 1265369 | A1 | 6/2001 |
| EP | 1309156 | A1 | 5/2003 |
| EP | 1422787 | A1 | 11/2003 |
| JP | 04-253927 | | 9/2004 |
| WO | 2007022098 | A1 | 8/2006 |

* cited by examiner

*Primary Examiner*—Tho Phan
(74) *Attorney, Agent, or Firm*—Kacvinsky LLC

(57) ABSTRACT

A system and apparatus for an extendable antenna architecture are described. The apparatus may include an antenna body having one or more antenna traces, and an antenna housing to couple to the antenna body. The antenna housing may have an extended position and a retracted position. The antenna housing may have a first external surface forming a substantially continuous plane with a second external surface for a device housing when in the retracted position. Other embodiments are described and claimed.

29 Claims, 8 Drawing Sheets

800

EXTENDABLE ANTENNA ARCHITECTURE

BACKGROUND

A wireless device typically operates using a radio transmitter/receiver ("transceiver") and an antenna. The antenna may be located on a given wireless device in accordance with various performance and design constraints. For example, a cellular telephone or handheld computer may sometimes have some or all of an antenna external to the housing of the device, in the form of a whip antenna, extendable antenna, antenna stubby, and so forth. Some antenna placements, however, may be undesirable since they may increase the overall size and shape of the wireless device, particularly for those wireless devices with smaller form factors such as a cellular telephone or handheld computer. Consequently, there may be a need for improvements in antenna design.

DETAILED DESCRIPTION

Figure 1:
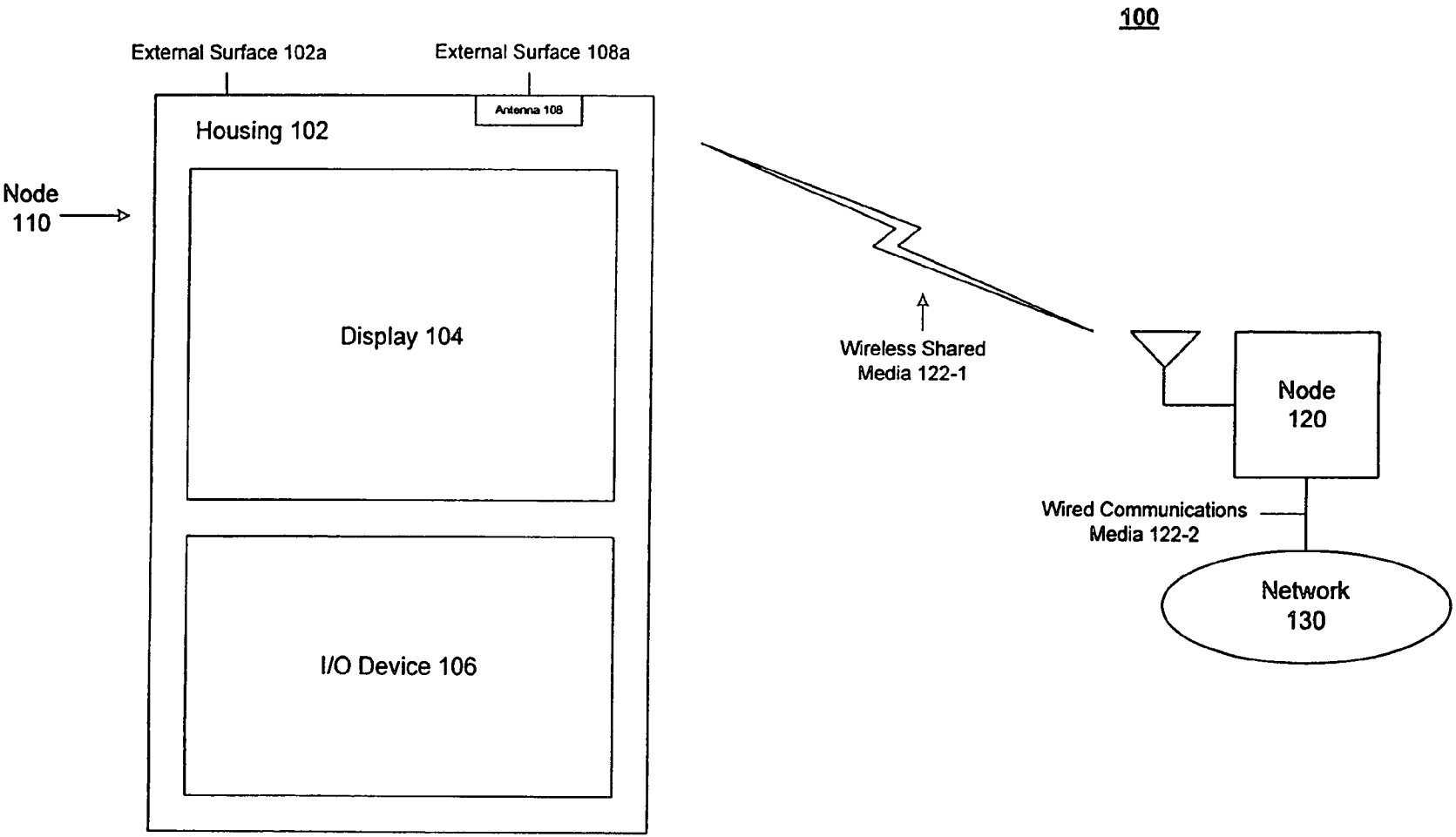
FIG. 1 illustrates one embodiment of a communication system.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

It is also worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment. Furthermore, in the drawings, the thickness of lines, dimensions, layers, features, components, and/or regions may be exaggerated for clarity.

Various embodiments may be directed to an antenna arrangement for a wireless device. In one embodiment, for example, a wireless device may include a transceiver and an antenna. The antenna may have an antenna body having one or more antenna traces. The antenna may also have an antenna housing to couple to the antenna body. The antenna housing may have a first external surface forming a substantially continuous plane with a second external surface for a wireless device housing for the wireless device. Consequently, various embodiments may potentially improve performance of a wireless device by improving one or more of characteristics of the wireless device, such as a size, shape, form factor, power consumption, battery life, transceiver operations, signal quality, weight, and other characteristics of the wireless device. Accordingly, a user may realize enhanced products and services.

FIG. 1 illustrates one embodiment of a system. FIG. 1 illustrates a block diagram of a system 100. In one embodiment, for example, system 100 may comprise a communication system having multiple nodes. A node may comprise any physical or logical entity for communicating information in the system 100 and may be implemented as hardware, software, or any combination thereof, as desired for a given set of design parameters or performance constraints. Although FIG. 1 is shown with a limited number of nodes in a certain topology, it may be appreciated that system 100 may include more or less nodes in any type of topology as desired for a given implementation. The embodiments are not limited in this context.

In various embodiments, a node may comprise a processing system, a computer system, a computer sub-system, a computer, a laptop computer, an ultra-laptop computer, a portable computer, a handheld computer, a personal digital assistant (PDA), a cellular telephone, a combination cellular telephone/PDA, a microprocessor, an integrated circuit, a programmable logic device (PLD), a digital signal processor (DSP), a processor, a circuit, a logic gate, a register, a microprocessor, an integrated circuit, a semiconductor device, a chip, a transistor, and so forth. The embodiments are not limited in this context.

In various embodiments, a node may comprise, or be implemented as, software, a software module, an application, a program, a subroutine, an instruction set, computing code, words, values, symbols or combination thereof. A node may be implemented according to a predefined computer language, manner or syntax, for instructing a processor to perform a certain function. Examples of a computer language may include C, C++, Java, BASIC, Perl, Matlab, Pascal, Visual BASIC, assembly language, machine code, micro-code for a processor, and so forth. The embodiments are not limited in this context.

System 100 may be implemented as a wired communication system, a wireless communication system, or a combination of both. Although system 100 may be illustrated using a particular communications media by way of example, it may be appreciated that the principles and techniques discussed herein may be implemented using any type of communication media and accompanying technology. The embodiments are not limited in this context.

When implemented as a wired system, for example, system 100 may include one or more nodes arranged to communicate information over one or more wired communications media. Examples of wired communications media may include a wire, cable, printed circuit board (PCB), backplane, switch fabric, semiconductor material, twisted-pair wire, co-axial cable, fiber optics, and so forth. The communications media may be connected to a node using an input/output (I/O) adapter. The I/O adapter may be arranged to operate with any suitable technique for controlling information signals between nodes using a desired set of communications protocols, services or operating procedures. The I/O adapter may also include the appropriate physical connectors to connect the I/O adapter with a corresponding communications medium. Examples of an I/O adapter may include a network interface, a network interface card (NIC), disc controller, video controller, audio controller, and so forth. The embodiments are not limited in this context.

When implemented as a wireless system, for example, system 100 may include one or more wireless nodes arranged to communicate information over one or more types of wireless communication media, sometimes referred to herein as wireless shared media. An example of a wireless communication media may include portions of a wireless spectrum, such as the radio-frequency (RF) spectrum. The wireless nodes may include components and interfaces suitable for communicating information signals over the designated wireless spectrum, such as one or more antennas, wireless transceivers, amplifiers, filters, control logic, and so forth. As used herein, the term "transceiver" may be used in a very general sense to include a transmitter, a receiver, or a combination of both. The embodiments are not limited in this context.

In various embodiments, system 100 may include a wireless node 110. Wireless node 110 may comprise any node arranged with wireless capabilities. Examples of wireless node 110 may include any of the previous examples for a node as previously described. In various embodiments, wireless node 110 may also be implemented as a handheld device. Examples of handheld devices may include a handheld computer, cellular telephone, PDA, combination cellular telephone/PDA, data transmission device, one-way pager, two-way pager, and so forth. The embodiments are not limited in this context.

In one embodiment, for example, wireless node 110 may be implemented as a handheld computer. As shown in FIG. 1, wireless node 110 may comprise a housing 102, a display 104, an input/output (I/O) device 106, and an antenna 108. Examples for I/O device 106 may include an alphanumeric keyboard, a numeric keypad, a touch pad, input keys, buttons, switches, rocker switches, and so forth. Although some embodiments may be described with wireless node 110 implemented as a handheld computer by way of example, it may be appreciated that other embodiments may be implemented using other wireless handheld devices as well. The embodiments are not limited in this context.

In one embodiment, system 100 may include a wireless node 120. Wireless node 120 may comprise, for example, a mobile station or fixed station having wireless capabilities. Examples for wireless node 120 may include any of the examples given for wireless node 110, and further including a wireless access point, base station or node B, router, switch, hub, gateway, and so forth. In one embodiment, for example, wireless node 120 may comprise a base station for a cellular radiotelephone communications system. Although some embodiments may be described with wireless node 120 implemented as a base station by way of example, it may be appreciated that other embodiments may be implemented using other wireless devices as well. The embodiments are not limited in this context.

In one embodiment, wireless nodes 110, 120 may comprise part of a cellular communication system. Examples of cellular communication systems may include Code Division Multiple Access (CDMA) cellular radiotelephone communication systems, Global System for Mobile Communications (GSM) cellular radiotelephone systems, North American Digital Cellular (NADC) cellular radiotelephone systems, Time Division Multiple Access (TDMA) cellular radiotelephone systems, Extended-TDMA (E-TDMA) cellular radiotelephone systems, Narrowband Advanced Mobile Phone Service (NAMPS) cellular radiotelephone systems, third generation (3G) systems such as Wide-band CDMA (WCDMA), CDMA-2000, Universal Mobile Telephone System (UMTS) cellular radiotelephone systems compliant with the Third-Generation Partnership Project (3GPP), and so forth. The embodiments are not limited in this context.

In addition to voice communication services, wireless nodes 110, 120 may be arranged to communicate using a number of different wireless wide area network (WWAN) data communication services. Examples of cellular data communication systems offering WWAN data communication services may include a GSM with General Packet Radio Service (GPRS) systems (GSM/GPRS), CDMA/1×RTT systems, Enhanced Data Rates for Global Evolution (EDGE) systems, Evolution Data Only or Evolution Data Optimized (EV-DO) systems, Evolution For Data and Voice (EV-DV) systems, High Speed Downlink Packet Access (HSDPA) systems, and so forth. The embodiments are not limited in this respect.

In one embodiment, communication system 100 may include network 130 connected to wireless node 120 by wired communications medium 122-2. Network 130 may comprise additional nodes and connections to other networks, including a voice/data network such as the Public Switched Telephone Network (PSTN), a packet network such as the Internet, a local area network (LAN), a metropolitan area network (MAN), a wide area network (WAN), an enterprise network, a private network, and so forth. Network 130 may also include other cellular radio telephone system equipment, such as base stations, mobile subscriber centers, central offices, and so forth. The embodiments are not limited in this context.

Communications between wireless nodes 110, 120 may be performed over wireless shared media 122-1 in accordance with a number of wireless protocols. Examples of wireless protocols may include various wireless local area network (WLAN) protocols, including the Institute of Electrical and Electronics Engineers (IEEE) 802.xx series of protocols, such as IEEE 802.11a/b/g/n, IEEE 802.16, IEEE 802.20, and so forth. Other examples of wireless protocols may include various WWAN protocols, such as GSM cellular radiotelephone system protocols with GPRS, CDMA cellular radiotelephone communication systems with 1×RTT, EDGE systems, EV-DO systems, EV-DV systems, HSDPA systems, and so forth. Further examples of wireless protocols may include wireless personal area network (PAN) protocols, such as an Infrared protocol, a protocol from the Bluetooth Special Interest Group (SIG) series of protocols, including Bluetooth Specification versions v1.0, v1.1, v1.2, v2.0, v2.0 with Enhanced Data Rate (EDR), as well as one or more Bluetooth Profiles, and so forth. Yet another example of wireless protocols may include near-field communication techniques and protocols, such as electro-magnetic induction (EMI) techniques. An example of EMI techniques may include passive or active radio-frequency identification (RFID) protocols and devices. Other suitable protocols may include Ultra Wide Band (UWB), Digital Office (DO), Digital Home, Trusted Platform Module (TPM), ZigBee, and other protocols. The embodiments are not limited in this context.

In various embodiments, wireless node 110 may include an antenna 108. In one embodiment, for example, antenna 108 may comprise a single antenna. In one embodiment, for example, antenna 108 may comprise one or more antennas which may operate at multiple bands such as in a quad band antenna architecture. A quad band antenna architecture may allow wireless node 110 to communicate using different frequency spectrums. For example, the quad band antenna may allow wireless device 110 to operate in the 824-894 Megahertz (MHz) frequency band for GSM operations, the 1850-1990 MHz frequency band for Personal Communications Services (PCS) operations, the 1575 MHz frequency band for Global Positioning System (GPS) operations, the 824-860 MHz frequency band for NAMPS operations, the 1710-2170 MHz frequency band for WCDMA/UMTS operations, and other frequency bands. This may be desirable since wireless node 110 may be compatible with multiple wireless data, multimedia and cellular telephone systems. In addition, a quad band antenna array may be used to implement various spatial diversity techniques to improve communication of wireless signals across one or more frequency bands of wireless shared media 122-1. The embodiments are not limited in this context.

The placement or location of an antenna on a given wireless device may be performed in accordance with various performance and design constraints. For example, the efficiency of an antenna may depend upon a proper relationship between the size and shape of the antenna and the wavelength of the targeted frequency. The specific frequency range that the antenna is designed to cover may dictate the optimal size of an antenna. Therefore, the specific implementation of an antenna such as antenna 108 may vary considerably depending upon such factors as the target operating frequencies, power consumption requirements, battery life, a form factor of the wireless device, transceiver operations, signal quality, weight considerations of the wireless device, and so forth.

Due to these and other considerations, conventional wireless devices may implement some or all of an antenna external to the housing of the device, in the form of a whip antenna, extendable antenna, antenna stubby, and so forth. Some antenna placements, however, may be undesirable since they may increase the overall size and shape of the wireless device. In addition, some external antenna placements may expose the antenna to potential damage. Further, some extendable antennas may provide reduced performance, and in some cases may not provide any performance at all, when in a retracted or closed position. Such problems may be further exacerbated with the smaller form factors typically associated with handheld devices, such as a handheld computer, PDA, cellular telephone, combination cellular telephone/PDA, and so forth.

Various embodiments may address these and other problems. In one embodiment, for example, wireless node 110 may include antenna 108. Antenna 108 may be used for transmitting and/or receiving electrical signals. During transmission, antenna 108 may accept energy from a transmission line and radiate this energy into space via wireless shared media 122-1. During reception, antenna 108 may gather energy from an incident wave received over wireless shared media 122-1, and provide this energy to a corresponding transmission line. The amount of power radiated from or received by antenna 108 is typically described in terms of gain. Antenna 108 may comprise a single antenna, or may be part of an array of antennas, such as a quad band antenna array. The embodiments are not limited in this context.

In various embodiments, antenna 108 may be an extendable antenna. An extendable antenna may be moved into multiple positions, such as first position and a second position. Energy for the movement is typically provided by a user, although automatic movement is possible as well. An example of a first position may include a retracted position. When in a retracted position, some or all of antenna 108 may be internal to housing 102 of wireless node 110. An example of a second position may include an extended position. When in an extended position, some or all of antenna 108 may be external to housing 102 of wireless node 110. The embodiments are not limited in this context.

In various embodiments, housing 102 of wireless node 110 may have various external surfaces. In one embodiment, for example, housing 102 may have an external surface 102*a* located at a top of wireless node 110 above display 104. Similarly, antenna 108 may also have various external surfaces. In one embodiment, for example, antenna 108 may have an external surface 108*a* located at a top of antenna 108, or more particularly, on top of an antenna housing for antenna 108, as described with reference to FIG. 2. The term "external surface" as used herein, however, may refer to any external surface of housing 102 and antenna 108, as long as the external surfaces for both housing 102 and antenna 108 are adjoining or adjacent to each other. Therefore, if antenna 108 were positioned on a bottom or side of wireless node 110, the term "external surface" of housing 102 may refer to the region adjoining or adjacent to the repositioned antenna 108, such as the bottom or side of housing 102, for example. The embodiments are not limited in this context.

When in a retracted position, antenna 108 may be integrated with wireless node 110 such that external surface 108*a* of antenna 108 is substantially even, aligned or flush with external surface 102*a* of housing 102 of wireless node 110. For example, external surface 108*a* and external surface 102*a* may combine to provide a relatively smooth and uniform surface or profile when antenna 108 is in a retracted position. The term "flush" as used herein may refer to two elements formed in a continuous plane. The two elements may be adjoining or adjacent to each other when forming the continuous plane. For example, the continuous plane may include any non-contiguous portions between housing 102 and antenna 108, such as any seams formed around antenna 108 to allow antenna 108 freedom of movement relative to housing 102. The continuous plane may comprise, for example, a linear plane or a curved plane. In one embodiment, for example, external surface 108*a* of antenna 108 may form a substantially continuous plane with an external surface 102*a* of housing 102 of wireless node 110 when in a retracted position. External surfaces 102*a*, 108*a* may comprise, for example, flat surfaces, curved surfaces (arcuate surfaces), or a combination of flat and curved surfaces. The retracted position may make antenna 108 less vulnerable to damage. In addition, the retracted position may reduce the overall size and profile of wireless node 110 relative to when antenna 108 is in the extended position.

In the extended position, external surface 108*a* of antenna 108 may extend beyond external surface 102*a* of housing 102. The extended position may increase the exposure of antenna 108, and therefore potentially achieve a corresponding increase in antenna efficiency. When in the extended position, external surface 108*a* of antenna 108 does not form a substantially continuous plane with external surface 102*a* of housing 102. Rather, external surface 108*a* of antenna 108 may be on a non-continuous or different plane than external surface 102*a* of housing 102. The embodiments are not limited in this context.

Figure 2:
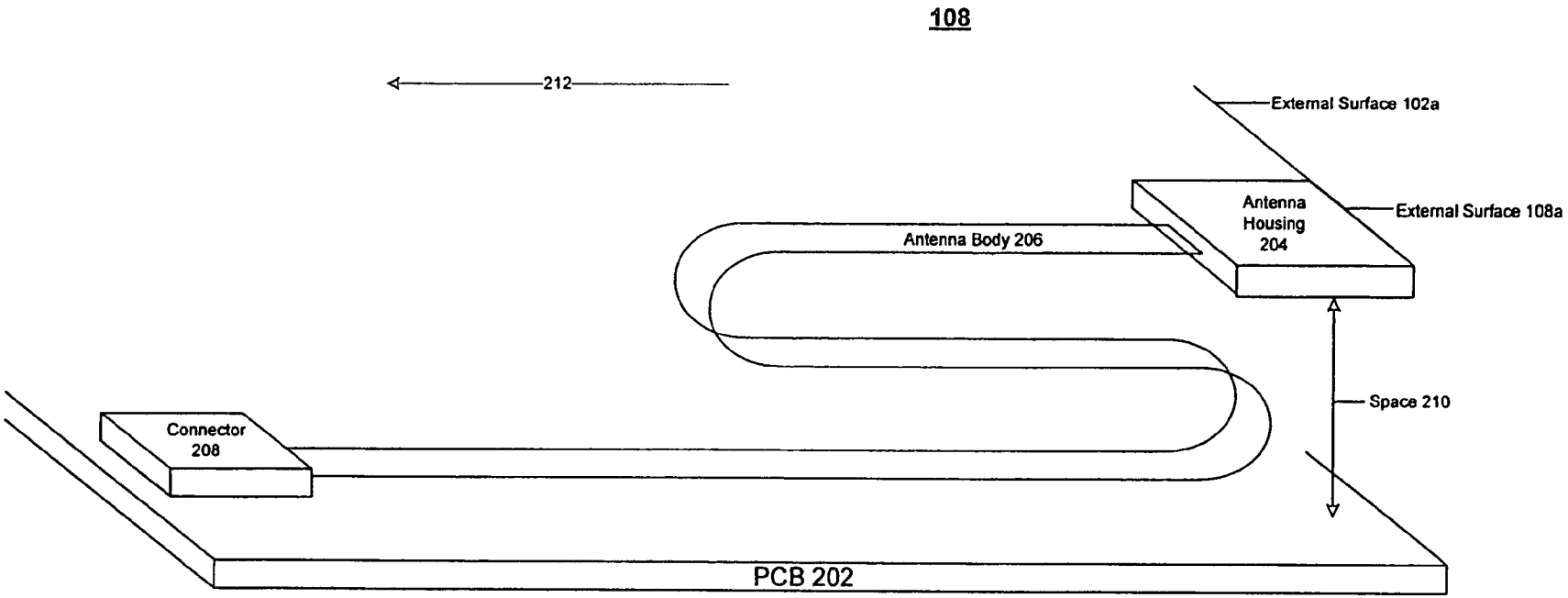
FIG. 2 illustrates a perspective view of one embodiment of a first antenna arrangement in a first position.

FIG. 2 illustrates a perspective view of one embodiment of a first antenna arrangement in a first position. FIG. 2 illustrates a more detailed view of antenna 108 suitable for use with wireless node 110. The embodiments are not limited, however, to the example given in FIG. 2.

As shown in FIG. 2, antenna 108 may comprise an antenna housing 204 connected to an antenna body 206. Antenna body 206 may be connected to a connector 208.

Connector 208 may be connected to an internal printed circuit board (PCB) 202. Antenna body 206, connector 208 and PCB 202 may all be disposed within housing 102. Antenna housing 204 may be disposed within housing 102 when in a retracted position, and partially or fully exposed outside of housing 102 when in an extended position. Although FIG. 2 shows a limited number of elements in a certain arrangement by way of example, it can be appreciated that antenna 108 and/or PCB 202 may comprise more or less elements as desired for a given implementation. For example, PCB 202 may comprise, or connect to, one or more transmission lines, a feed source, a feed pad, a feed line, a ground source, a ground pad, a ground line, a transceiver, a processor, a power source such as a battery, and other components typically used to implement an antenna with a transceiver for wireless node 110.

In various embodiments, antenna components 204, 206 and 208 may be arranged to transmit and receive electrical energy in accordance with a given set of performance or design constraints as desired for a particular implementation. For example, antenna body 206 may have multiple layers and multiple antenna traces. The antenna traces may have any suitable pattern or geometry tuned for various operating frequencies. For example, the antenna traces may comprise one or more center lines and/or branch lines. The branch lines may be parasitic, or directly connected to the center lines. The center lines may be straight or in any kind of meandered structure. Phase lines and/or various chip components, such as resistors, capacitors or inductors, may be used among the center lines and/or branch lines. Resonant lines in different layers could be electrically contacted or parasitic. In addition, antenna components 204, 206 and 208 may operate in accordance with a desired Voltage Standing Wave Ratio (VSWR) value. For example, VSWR relates to the impedance match of an antenna feed point with a feed line or transmission line of a communications device, such as wireless node 110. To radiate radio frequency energy with minimum loss, or to pass along received RF energy to a wireless receiver of wireless node 110 with minimum loss, the impedance of antenna 108 may be matched to the impedance of a transmission line or feed point of PCB 202. Antenna 108 of wireless node 110 may be electrically connected to a transceiver 806 (described with reference to FIG. 8) operatively associated with a signal processing circuit or processor positioned on PCB 202. In order to increase the power transfer between antenna 108 and transceiver 806, transceiver 806 and antenna 108 may be interconnected such that their respective impedances are substantially matched or electrically tuned to compensate for undesired antenna impedance components in order to provide a desired impedance value at the feed point, such as 50-Ohm (Ω), for example. The embodiments are not limited in this context.

In various embodiments, antenna body 206 may be made of a flexible material or substrate. A flexible material may include any pliant material that is capable of being bent or flexed. In one embodiment, for example, antenna body 206 may be implemented using a flexible printed circuit (FPC). Other flexible materials may be used, however, such as a wire material, helical material, teflon material, RF4 material, mylar material, dielectric substrate, a soft plastic material, and other flexible materials. The embodiments are not limited in this context.

In various embodiments, antenna housing 204 may comprise any housing or cap having an internal cavity at a first end sized to accommodate a first end of antenna body 206. During assembly, the first end of antenna body 206 may be inserted into the internal cavity and bonded to antenna housing 204 securely enough that movement of antenna housing 204 may cause a corresponding movement in antenna body 206. Antenna housing 204 may have a shape that may be compatible with housing 102 of wireless node 110. In one embodiment, for example, antenna housing 204 may have a substantially flat, planar or rectangular shape, although other geometries may be used. Antenna housing 204 may also have a second end comprising a flat or curved external surface 108*a* formed to substantially align or match a flat or curved external surface 102*a*. Antenna housing 204 may be formed using any suitable material compatible with the antenna design and performance characteristics of antenna 108, such as a hard plastic material, a soft plastic material, a rubber material, a nylon material, a ceramic material, a metal material, and so forth. The embodiments are not limited in this context.

In various embodiments, a second end of antenna body 206 may be connected to connector 208 to communicate signals between PCB 202 and antenna 108. Connector 208 may comprise any suitable connector arranged to communicate electrical signals between antenna body 206 and PCB 202. For example, connector 208 may have various leads to connect to various corresponding transmission lines, feed lines, ground lines, and so forth, of PCB 202. Connector 208 may also have various leads to connect to the appropriate antenna traces of antenna body 206.

FIG. 2 illustrates antenna 108 in a first position. The first position may comprise, for example, a retracted position. As previously described, antenna 108 may be extendable and therefore may be moved into different positions, such as a retracted position and an extended position. To place antenna 108 in the retracted position from an extended position, a force or pressure may be applied to antenna housing 204 in a direction 212 to slide, push or otherwise move external surface 108*a* of antenna housing 204 towards housing 102 until external surface 108*a* of antenna housing 204 forms a substantially flat or curved continuous plane with external surface 102*a* of housing 102. Guide rails or some other mechanical structures may be used to guide antenna housing 204 in the desired direction 212. Guide stops may be used to limit movement of antenna housing 204 towards housing 102 or away from housing 102, as well as to limit lateral movement of antenna housing 204, as desired for a given implementation. A spring may also be used to bias antenna housing 204 to provide a desired amount of resistance when pressure is applied to antenna housing 204.

When moving into the retracted position, the flexible material of antenna body 206 may flex and bend to accommodate the movement of antenna housing 204. For example, antenna body 206 may flex and bend to form multiple layers stacked between antenna housing 204 and PCB 202. The layers should fit or be capable of conforming to a space 210 between PCB 202 and antenna housing 204. Space 210 may be a free band of space between antenna 108 and PCB 202, the size of which may vary depending upon the material of PCB 202, as well as other factors. In one embodiment, for example, space 210 may be approximately 7 millimeters (mm) or greater depending upon whether there is any metal disposed on PCB 202 underneath antenna housing 204 of antenna 108. In various embodiments, PCB 202 may be arranged such that there is no metal beneath antenna housing 204 when in a retracted position in order to create the appropriate ground plane for antenna 108. In one embodiment, for example, PCB 202 may have a rectangular area of approximately 10 mm directly under antenna housing 204 that is free of any metals. The embodiments are not limited in this context.

It is worthy to note that the number of layers and/or lengths for each layer of antenna body 206 as shown in FIG. 2 are exaggerated for clarity. As shown in FIG. 2, antenna body 206 may have three layers when in the retracted position. Antenna body 206 may have more or less layers, however, depending upon a given implementation. The actual number of layers, and length of each individual layer, may vary for a particular implementation based on an amount of movement needed for antenna housing 204 to move into the extended position. The embodiments are not limited in this context.

Figure 3:
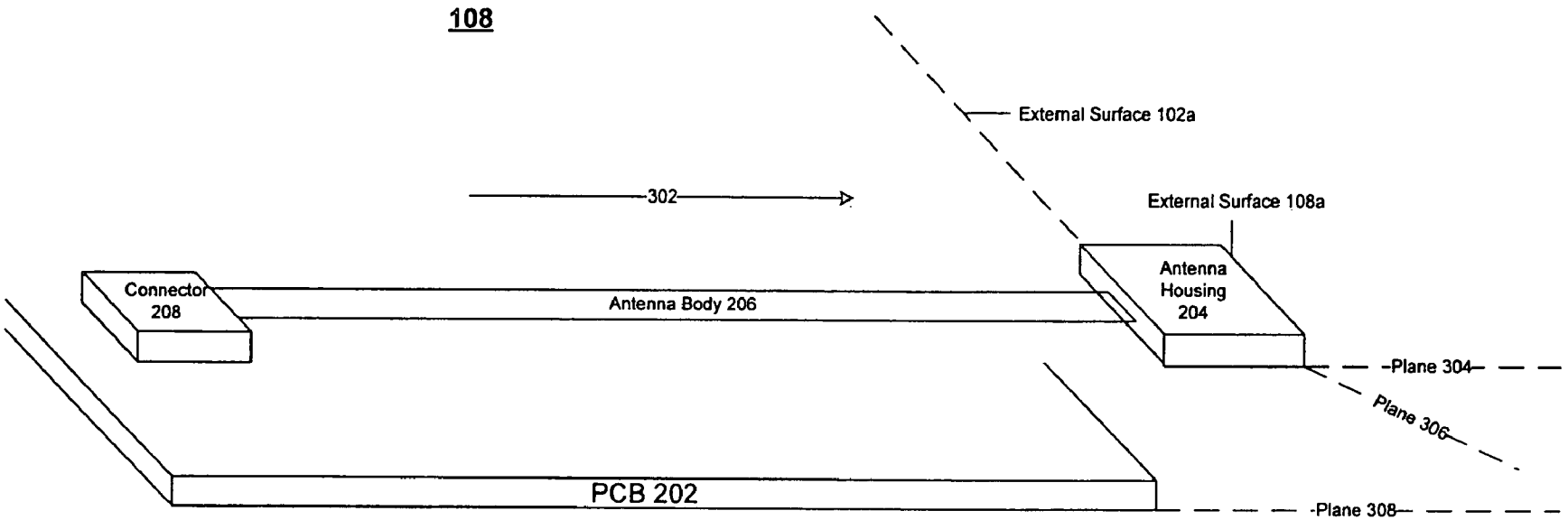
FIG. 3 illustrates a perspective view of one embodiment of a first antenna arrangement in a second position.

FIG. 3 illustrates a perspective view of one embodiment of a first antenna arrangement in a second position. The second position may comprise, for example, an extended position. To place antenna 108 in the extended position, a force or pressure may be applied to antenna housing 204 in a direction 302 to slide, pull, push or otherwise move antenna housing 204 away from housing 102 until antenna housing 204 is exposed by a desired amount outside of housing 102. A spring may be used to bias antenna housing 204 to assist in pushing antenna housing 204 in direction 302. Guide stops or other mechanical elements may be used to constrain the amount of movement of antenna housing 204 in direction 302. In one embodiment, for example, antenna housing 204 may be extended until antenna housing 204 is partially or completely exposed above external surface 102*a* of housing 102. The actual distance antenna housing 204 may move to reach the extended position may vary in accordance with a given implementation. The embodiments are not limited in this context.

When moving into the extended position, the flexible material of antenna body 206 may flex or bend to accommodate the movement of antenna housing 204. Since antenna body 206 is stacked in layers when in the retracted position, movement of antenna housing 204 may pull antenna body 206 in a manner that releases one or more layers until antenna housing 204 is in the extended position. In the extended position, antenna body 206 should be positioned so that when force is applied to return antenna housing 204 to the retracted position, antenna body 206 flexes or bends in the appropriate manner to form the requisite number of original layers. This may be accomplished by using the appropriate mechanical structures to guide antenna body 206 to the desired retracted position. Alternatively, antenna body 206 may remain partially bent or flexed while in the extended position to facilitate a return to the desired stacked layer condition of the retracted position. The embodiments are not limited in this context.

In various embodiments, movement of antenna housing 204 in direction 302 may be constrained to control a desired angle between PCB 202 and antenna housing 204. In one embodiment, for example, antenna housing 204 may be extended in direction 302 along a first plane 304 which is substantially parallel to a second plane 308 of PCB 202 when in an extended position. In this case, antenna housing 204 may be substantially parallel to PCB 202 when in the extended position. Alternatively, antenna housing 204 may be extended in a direction 302 along a third plane 306 which may eventually intersect second plane 308. In this case, antenna housing 204 may be at an angle to PCB 202 when in the extended position. The latter case may be desirable, for example, to allow more distance between a user and antenna housing 204 when in the extended position. The particular angle may be any angle desired for a given implementation. The embodiments are not limited in this context.

Figure 4B:
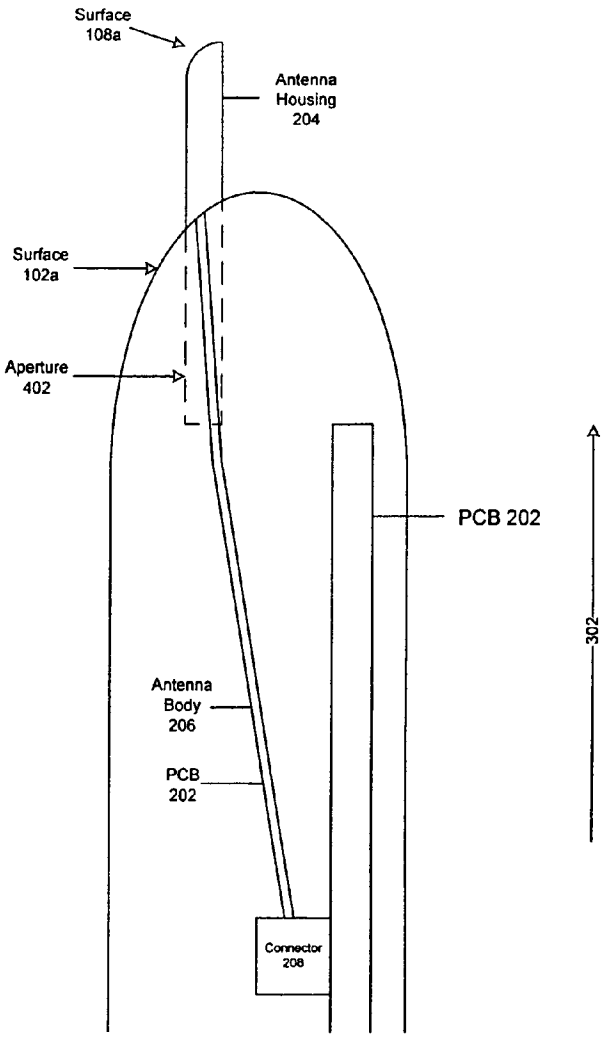
FIG. 4B illustrates a side view of one embodiment of a first antenna arrangement in a second position.
Figure 4A:
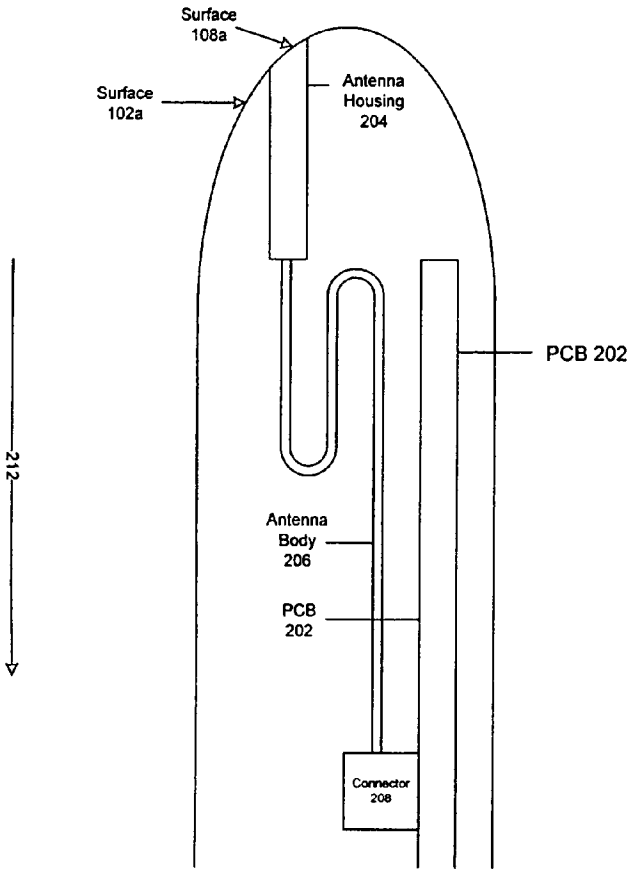
FIG. 4A illustrates a side view of one embodiment of a first antenna arrangement in a first position.

FIG. 4A illustrates a side view of one embodiment of a first antenna arrangement in a first position. FIG. 4A illustrates another view of antenna 108 in a retracted position. As shown in FIG. 4A, external surface 108*a* of antenna housing 204 forms a substantially curved continuous plane with external surface 102*a* of housing 102. Although there may be seams surrounding antenna housing 204 to allow antenna housing 204 to move between a retracted position and an extended position, the profile of wireless node 110 remains fairly smooth and unbroken from casual observation. Antenna body 206 is made of a flexible material that allows it to flex and bend to form multiple layers between antenna housing 204 and PCB 202.

FIG. 4B illustrates a side view of one embodiment of a first antenna arrangement in a second position. FIG. 4B illustrates another view of antenna 108 in an extended position. As shown in FIG. 4B, surface 108*a* of antenna housing 204 forms a non-continuous or different plane than the plane of surface 102*a* of housing 102 when in the extended position. Since antenna body 206 is made of a flexible material, antenna body 206 may begin to flex or unbend as antenna housing 204 moves in direction 302 away from housing 102 thereby allowing antenna housing 204 to move into the extended position. Alternatively, a portion of antenna body 206 may remain in a stacked layer position, with only a top layer of antenna body 206 to flex or unbend in order to accommodate the movement of antenna housing 204. Although FIG. 4B illustrates antenna body 206 in a substantially straightened position when antenna housing 204 is in an extended position, it may be appreciated that this is by way of example only and that antenna body 206 may be in other positions (e.g., layered) when in the extended position and still fall within the scope of the embodiments. The embodiments are not limited in this context.

The movement of antenna housing 204 may be facilitated by an antenna cavity 402 which operates as a channel to guide antenna housing 204 during movement between the retracted position and extended position, as well as provide stability for antenna 108 when in the extended position. Antenna cavity 402 may be sized to allow antenna housing 204 sufficient room or space to slide into housing 102 to achieve the desired profile of housing 102 when antenna 108 is in the retracted position.

Figure 5:
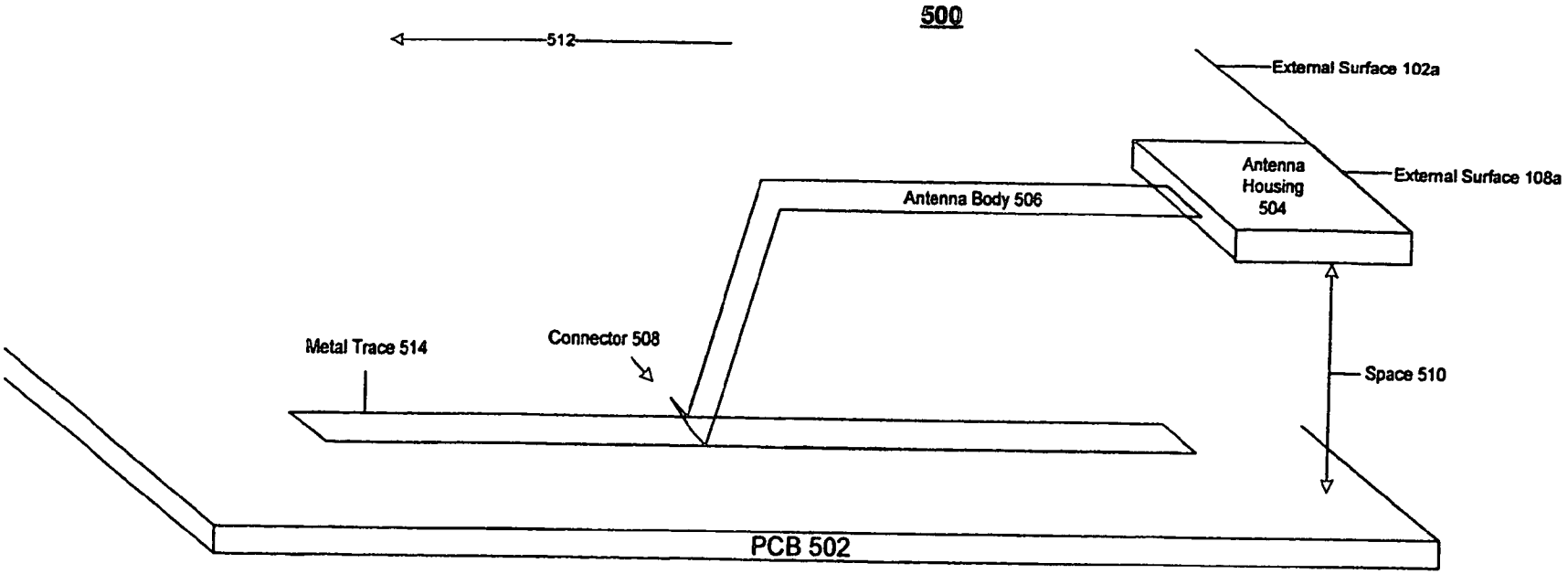
FIG. 5 illustrates a perspective view of one embodiment of a second antenna arrangement in a first position.

FIG. 5 illustrates a perspective view of one embodiment of a second antenna arrangement in a first position. FIG. 5 illustrates an antenna 500 suitable for use with wireless node 110. The embodiments are not limited, however, to the example given in FIG. 5.

In various embodiments, antenna 500 may be similar in some respects to antenna 108 as described with reference to FIG. 1. For example, elements 502, 504, 506, 510 and 512 may be similar in structure and operation as corresponding elements 202, 204, 206, 210 and 212, respectively, as described with reference to FIG. 2. There are some structural and operational differences, however, between antenna body 206 and antenna body 506. Furthermore, the use of connector 208 may be omitted in antenna 500.

In various embodiments, antenna body 506 may be made of a rigid material rather than a flexible material as used with antenna body 206. A rigid material may include any material that is deficient in or devoid of flexibility. Examples of rigid materials may include metal materials, plastic materials, ceramic materials, and so forth. In one embodiment, for example, antenna body 206 may be formed using a flat stamped metal having suitable characteristics to match the design and performance constraints for a given wireless node. Antenna traces may be disposed upon the metal material of antenna body 206 using chemical etching, metal etching, and other similar techniques. The embodiments are not limited in this context.

In various embodiments, antenna body 506 may have a trace contact 508 formed at a second end of antenna body 506. Trace contact 508 and a metal trace 514 disposed on PCB 502 may replace connector 208. Trace contact 508 may be formed by bending or stamping a second end of antenna body 506 to form a shape that covers a width of metal trace 514. In one embodiment, for example, trace contact 508 may be formed into a V-shaped geometry, with the width of trace contact 508 matching or exceeding the width of metal trace 514. Other sizes and shapes are possible as long as they are able to maintain consistent electrical contact between antenna 500 and PCB 502. The embodiments are not limited in this context.

In various embodiments, antenna body 506 may be positioned such that trace contact 508 makes constant contact with metal trace 514 of PCB 502. Metal trace 514 may be electrically connected to various transmission lines, feed lines, ground lines and so forth disposed upon PCB 502. In various embodiments, antenna body 506 should be positioned such that trace contact 508 may stay in continuous contact with metal trace 514, but may also slide along the length of metal trace 502 in directions 512 and 602 when antenna 500 is moved between a retracted position and an extended position. In various embodiments, a spring or other bias technique may be used to ensure that trace contact 508 and metal trace 514 remain in contact when in the retracted position, extended position, or when moving between positions.

FIG. 5 illustrates antenna 500 in a retracted position. As with antenna 108, antenna 500 may be extendable and therefore may be moved into different positions. To place antenna 500 in the retracted position, a force or pressure may be applied to antenna housing 504 in a direction 512 to slide, push or otherwise move antenna housing 504 towards housing 102 until external surface 108*a* of antenna housing 504 forms a substantially flat or curved continuous plane with external surface 102*a* of housing 102. Guide rails or some other mechanical structures may be used to guide antenna housing 504 in the desired direction 512. Guide stops may be used to limit movement of antenna housing 504 towards housing 102 or away from housing 102, as desired for a given implementation. A spring may also be used to bias antenna housing 504 to provide a desired amount of resistance when pressure is applied to antenna housing 504. The embodiments are not limited in this context.

When moving into the retracted position, the rigid material of antenna body 506 may remain fixed and inflexible. Therefore, antenna body 506 may cause trace contact 508 to slide along metal trace 514 as antenna housing 504 is moved to a retracted position. Since trace contact 508 remains electrically connected to metal trace 514 during movement, electrical signals may be continuously communicated between antenna 500 and PCB 502 when in the retracted position, the extended position, or when moving between both positions.

Figure 6:
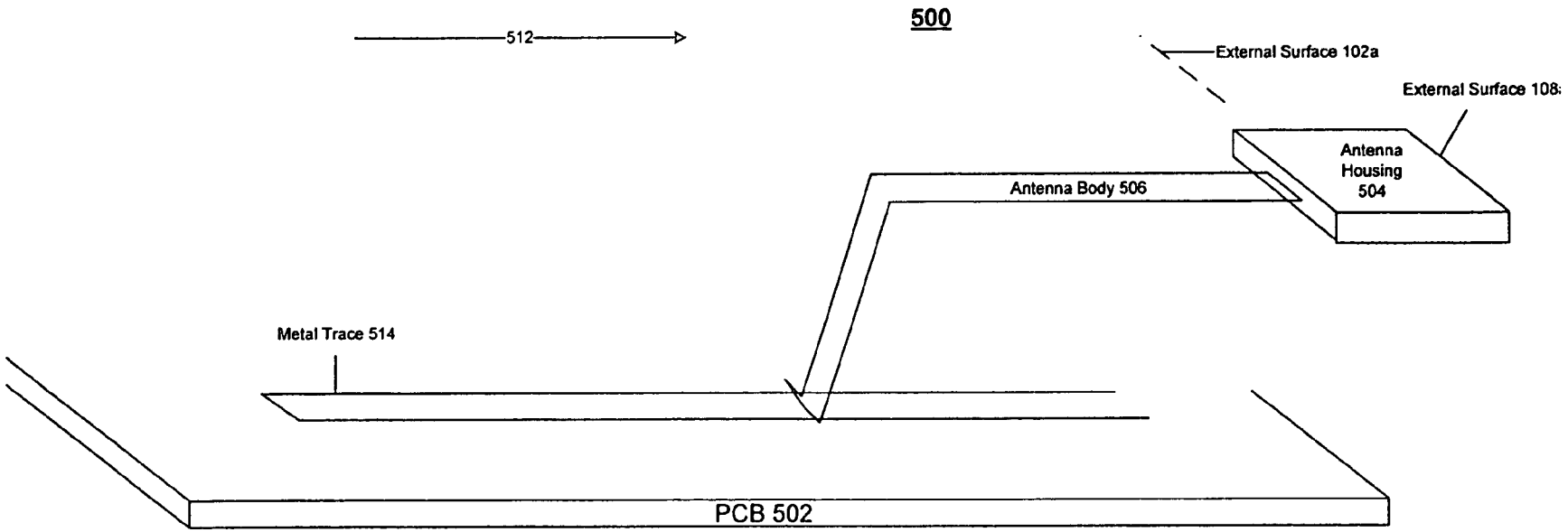
FIG. 6 illustrates a perspective view of one embodiment of a second antenna arrangement in a second position.

FIG. 6 illustrates a perspective view of one embodiment of a second antenna arrangement in a second position. The second position may comprise, for example, an extended position. To place antenna 500 in the extended position, a force or pressure may be applied to antenna housing 504 in a direction 602 to slide, pull, push or otherwise move antenna housing 504 away from housing 102 until antenna housing 504 is a desired distance from housing 102. A spring may bias antenna housing 504 to assist in pushing antenna housing 504 in direction 602. Guide stops or other mechanical elements may be used to constrain the amount of movement of antenna housing 504 in direction 602. In one embodiment, for example, antenna housing 504 may be extended until antenna housing 504 is partially or completely exposed from external surface 102*a* of housing 102. The actual distance may vary in accordance with a given implementation. The embodiments are not limited in this context.

When moving into the extended position, the rigid material of antenna body 506 may cause trace contact 508 to move along metal trace 514. Since trace contact 508 remains in electrically contact with metal trace 514 during movement, electrical signals may be constantly communicated between antenna 500 and PCB 502 when in the retracted position, the extended position, or when moving between both positions.

In various embodiments, movement of antenna housing 504 in direction 602 may be constrained to control a desired angle between PCB 502 and antenna housing 504. As with antenna 108, antenna housing 504 of antenna 500 may be extended in direction 602 along a first plane which is substantially parallel to a second plane of PCB 502 when in an extended position. In this case, antenna housing 504 may be substantially parallel to PCB 502 when in the extended position. Alternatively, antenna housing 504 may be extended in a direction 602 along a third plane which may eventually intersect the second plane. In this case, antenna housing 504 may be at an angle to PCB 502 when in the extended position. This may be desirable, for example, to allow more distance between a user and antenna housing 504 when in the extended position. The particular angle may be any angle desired for a given implementation. The embodiments are not limited in this context.

Figure 7:
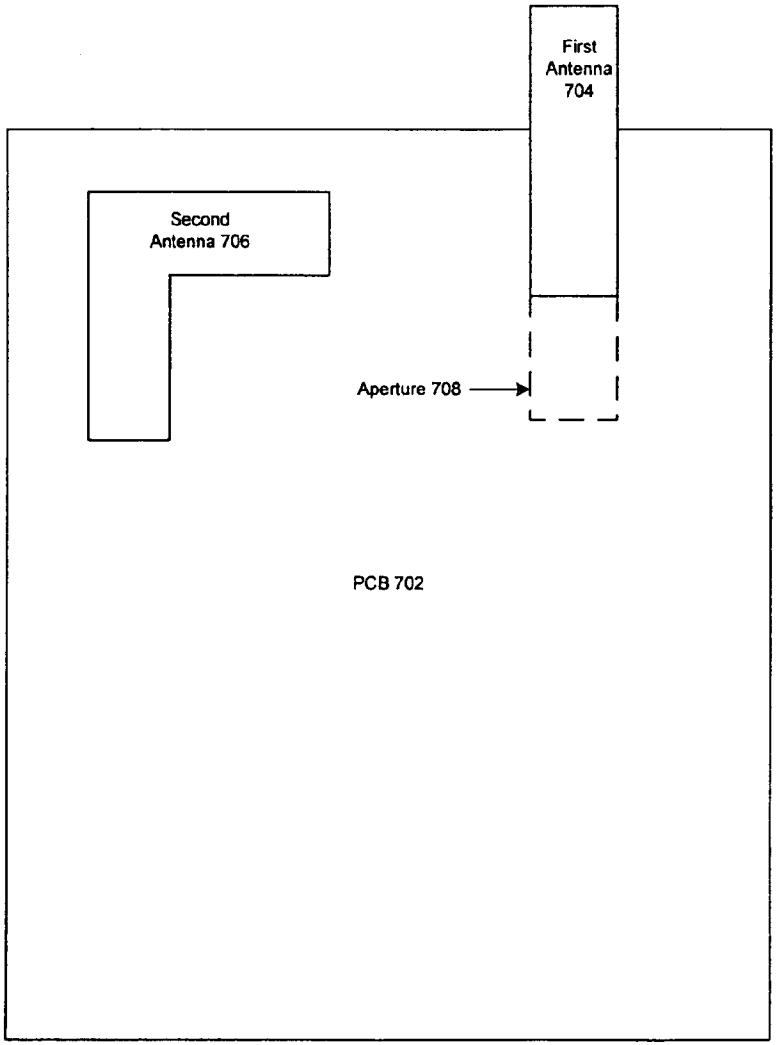
FIG. 7 illustrates one embodiment of an antenna array.

FIG. 7 illustrates one embodiment of an antenna array. FIG. 7 illustrates a block diagram of an antenna array 700. In one embodiment, for example, antenna array 700 may be suitable for use with a wireless node, such as wireless node 110. Antenna array 700 may comprise multiple antennas, such as antennas 704, 706. Antenna array 700 may be used to implement diversity for a multiple-input-multiple-output (MIMO) system. For example, antennas 704, 706 may be tuned for operating at one or more frequency bands. Antenna 704 may be a primary antenna implemented using any of the antennas described herein, such as antenna 108 and/or antenna 500. Antenna 706 may be a secondary antenna disposed within housing 102 of wireless node 110. Antenna 706 may be implemented using any type of suitable internal antenna, such as a planar inverted-F antenna, a planar inverted-L antenna, an inverted-F antenna with a helical structure, an inverted-L antenna with a helical structure, a monopole antenna, a dipole antenna, a chip antenna, and a ceramic antenna. Antenna 706 may be made of two or more antenna elements. The different elements may be contacted or parasitic. In one embodiment, for example, antenna 706 may be disposed on PCB 702. The embodiments, however, are not limited in this context.

As shown in FIG. 7, antenna 704 may be moved between a retracted position and an extended position. When in an extended position, movement of antenna 704 may create an antenna cavity 708 within housing 102 of wireless node 110. When in a retracted position, antenna cavity 708 may be sized to provide sufficient space to allow antenna 704 to recede within housing 102 such that external surface 108*a* remains flush with external surface 102*a* of housing 102. By way of contrast, antenna 706 may remain in a fixed position internal to housing 102. The embodiments are not limited in this context.

In various embodiments, antennas 704, 706 may have varying polarities to implement one or more diversity techniques. In one embodiment, for example, antenna 704 may be vertically polarized. In this case, antenna 706 may be mainly horizontally polarized or vertically polarized with a cross-polarization component. The embodiments are not limited in this context.

Figure 8:
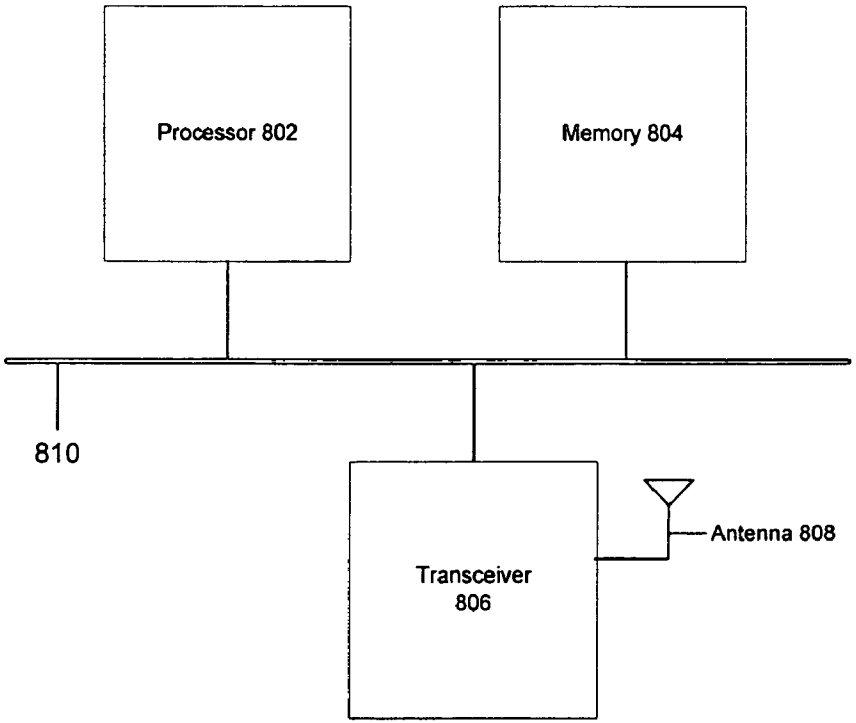
FIG. 8 illustrates one embodiment of a wireless node.

FIG. 8 illustrates one embodiment of a wireless node. FIG. 8 illustrates a partial block diagram of a wireless node 800 suitable for use with system 100 as described with reference to FIG. 1, such as wireless node 110, for example. The embodiments are not limited, however, to the example given in FIG. 8.

As shown in FIG. 8, wireless node 800 may comprise multiple elements, such as a processor 802, a memory 804, a transceiver 806, and an antenna 808, all connected by a communications bus 810. One or more elements may be implemented using one or more circuits, components, registers, processors, software subroutines, modules, or any combination thereof, as desired for a given set of design or performance constraints. Although FIG. 8 shows a limited number of elements in a certain topology by way of example, it can be appreciated that more or less elements in any suitable topology may be used in wireless node 800 as desired for a given implementation. The embodiments are not limited in this context.

In various embodiments, wireless node 800 may include a processor 802. Processor 802 may be implemented using any processor or logic device, such as a complex instruction set computer (CISC) microprocessor, a reduced instruction set computing (RISC) microprocessor, a very long instruction word (VLIW) microprocessor, a processor implementing a combination of instruction sets, or other processor device. In one embodiment, for example, processor 802 may be implemented as a general purpose processor, such as a processor made by Intel® Corporation, Santa Clara, Calif. Processor 802 may also be implemented as a dedicated processor, such as a controller, microcontroller, embedded processor, a digital signal processor (DSP), a network processor, a media processor, an input/output (I/O) processor, a media access control (MAC) processor, a radio baseband processor, a field programmable gate array (FPGA), a programmable logic device (PLD), and so forth. The embodiments, however, are not limited in this context.

In various embodiments, wireless node 800 may include a memory 804 to connect to processor 802. Memory 804 may be implemented using any machine-readable or computer-readable media capable of storing data, including both volatile and non-volatile memory. For example, memory 804 may include read-only memory (ROM), random-access memory (RAM), dynamic RAM (DRAM), Double-Data-Rate DRAM (DDRAM), synchronous DRAM (SDRAM), static RAM (SRAM), programmable ROM (PROM), erasable programmable ROM (EPROM), electrically erasable programmable ROM (EEPROM), flash memory, polymer memory such as ferroelectric polymer memory, ovonic memory, phase change or ferroelectric memory, silicon-oxide-nitride-oxide-silicon (SONOS) memory, magnetic or optical cards, or any other type of media suitable for storing information. It is worthy to note that some portion or all of memory 804 may be included on the same integrated circuit as processor 802, or alternatively some portion or all of memory 804 may be disposed on an integrated circuit or other medium, for example a hard disk drive, that is external to the integrated circuit of processor 802. The embodiments are not limited in this context.

In various embodiments, wireless node 800 may include a wireless or radio transceiver 806. Wireless transceiver 806 may comprise any transceiver suitable for operating at a given set of operating frequencies and wireless protocols for a particular wireless system. For example, transceiver 806 may be a two-way radio transceiver arranged to operate in the 824-894 MHz frequency band (GSM), the 1850-1990 MHz frequency band (PCS), the 1575 MHz frequency band (GPS), the 824-860 MHz frequency band (NAMPS), the 1710-2170 MHz frequency band (WCDMA/UMTS), or other frequency bands. In one embodiment, for example, transceiver 806 may be implemented as part of a chip set associated with processor 802. Transceiver 806 may be coupled to antenna 808. Antenna 808 may be representative of any of the antenna architectures described herein, such as antennas 108, 500 and 700, and tuned to transmit and receive electrical energy at the same or similar frequency bands used by transceiver 806. The embodiments are not limited in this context.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

The invention claimed is:

1. An apparatus, comprising:

an antenna body having one or more antenna traces; and an antenna housing to couple to said antenna body, said antenna housing having an extended position and a retracted position, said antenna housing to have a first external surface forming a substantially continuous plane with a second external surface for a device housing when in said retracted position;

wherein said antenna body comprises a flexible material that bends to form multiple layers between said antenna housing and a printed circuit board.

2. The apparatus of claim 1, wherein said substantially continuous plane comprises a linear plane or a curved plane.

3. The apparatus of claim 1, wherein said first and second external surfaces comprise flat surfaces or curved surfaces.

4. The apparatus of claim 1, comprising a connector to electrically couple said antenna body to a printed circuit board.

5. The apparatus of claim 1, said antenna housing to be in a plane substantially parallel to a plane of a printed circuit board when in said extended position.

6. The apparatus of claim 1, wherein said device housing is for a wireless handheld device.

7. An apparatus, comprising:

an antenna body having one or more antenna traces; and an antenna housing to couple to said antenna body, said antenna housing having an extended position and a retracted position, said antenna housing to have a first external surface forming a substantially continuous plane with a second external surface for a device housing when in said retracted position;

wherein said antenna body comprises a rigid material, and one end of said antenna body forms a trace contact to contact a metal trace disposed on a printed circuit board.

8. An apparatus, comprising:

an antenna body having one or more antenna traces; and an antenna housing to couple to said antenna body, said antenna housing having an extended position and a retracted position, said antenna housing to have a first external surface forming a substantially continuous plane with a second external surface for a device housing when in said retracted position;

wherein one end of said antenna body forms a trace contact to contact a metal trace disposed on a printed circuit board, said trace contact to slide on said metal trace while remaining in contact with said metal trace when in said extended position, said retracted position, and moving between said positions.

9. An apparatus, comprising:

an antenna body having one or more antenna traces; and an antenna housing to couple to said antenna body, said antenna housing having an extended position and a retracted position, said antenna housing to have a first external surface forming a substantially continuous plane with a second external surface for a device housing when in said retracted position;

said antenna housing to be in a plane at an angle to a plane of a printed circuit board when in said extended position.

10. An antenna array, comprising:

a first antenna having an antenna body coupled to an antenna housing, said antenna housing having an extended position and a retracted position, said antenna housing to have a first external surface forming a substantially continuous plane with a second external surface for a wireless device housing when in a retracted position; wherein said antenna body comprises a flexible material that bends to form multiple layers between said antenna housing and a printed circuit board.

11. The antenna array of claim 10, comprising a second antenna disposed within said wireless device housing, said first antenna and said second antenna to form a quad band antenna.

12. The antenna array of claim 10, comprising a second antenna disposed within said wireless device housing, said second antenna comprising one of a planar inverted-F antenna, a planar inverted-L antenna, an inverted-F antenna with a helical structure, an inverted-L antenna with a helical structure, a monopole antenna, a dipole antenna, a chip antenna, and a ceramic antenna.

13. The antenna array of claim 10, comprising a second antenna, said first antenna to be vertically polarized, and said second antenna to be horizontally polarized or vertically polarized with a cross-polarization component.

14. An apparatus, comprising:

an antenna, said antenna to comprise:

an antenna body having one or more antenna traces;

an antenna housing to couple to said antenna body, said antenna housing to have a first external surface; and a printed circuit board to couple to said antenna body;

a transceiver to couple to said printed circuit board; and a wireless device housing having a second external surface, said wireless device housing to house said antenna, said printed circuit board, and said transceiver, and said first external surface to form a substantially continuous plane with said second external surface when in a retracted position;

wherein said antenna body comprises a flexible material that bends to form multiple layers between said antenna housing and a printed circuit board.

15. The apparatus of claim 14, wherein said substantially continuous plane comprises a linear plane or a curved plane.

16. The apparatus of claim 14, wherein said first and second external surfaces comprise flat surfaces or curved surfaces.

17. The apparatus of claim 14, comprising a connector to electrically couple said antenna body to a printed circuit board.

18. An apparatus, comprising:

an antenna, said antenna to comprise:

an antenna body having one or more antenna traces;

an antenna housing to couple to said antenna body, said antenna housing to have a first external surface; and a printed circuit board to couple to said antenna body;

a transceiver to couple to said printed circuit board; and a wireless device housing having a second external surface, said wireless device housing to house said antenna, said printed circuit board, and said transceiver, and said first external surface to form a substantially continuous plane with said second external surface when in a retracted position;

wherein said antenna body comprises a rigid material, and one end of said antenna body forms a trace contact to contact a metal trace disposed on a printed circuit board.

19. An apparatus, comprising:

an antenna, said antenna to comprise:

an antenna body having one or more antenna traces;

an antenna housing to couple to said antenna body, said antenna housing to have a first external surface; and a printed circuit board to couple to said antenna body;

a transceiver to couple to said printed circuit board; and a wireless device housing having a second external surface, said wireless device housing to house said antenna, said printed circuit board, and said transceiver, and said first external surface to form a substantially continuous plane with said second external surface when in a retracted position;

wherein one end of said antenna body forms a trace contact to contact a metal trace disposed on a printed circuit board, said trace contact to slide on said metal trace while remaining in contact with said metal trace when in said extended position, said retracted position, and moving between said positions.

20. A wireless handheld device, comprising:

a wireless handheld device housing having disposed therein:

a processor;

a memory to couple to said processor;

a transceiver to couple to said processor; and an antenna to couple to said transceiver, said antenna to comprise:

an antenna body having one or more antenna traces;

an antenna housing to couple to said antenna body, said antenna housing to have a first external surface; and wherein said wireless handheld device housing comprises a second external surface, said first external surface to form a substantially continuous plane with said second external surface;

wherein said antenna body comprises a flexible material that bends to form multiple layers between said antenna housing and a printed circuit board.

21. The wireless handheld device of claim 20, wherein said substantially continuous plane comprises a linear plane or a curved plane.

22. The wireless handheld device of claim 20, wherein said first and second external surfaces comprise flat surfaces or curved surfaces.

23. The wireless handheld device of claim 20, comprising a connector to electrically couple said antenna body to a printed circuit board.

24. The wireless handheld device of claim 20, wherein said antenna comprises a first antenna in an antenna array, and further comprising a second antenna disposed within said wireless handheld device housing, said first antenna and said second antenna to form a quad band antenna.

25. The wireless handheld device of claim 20, said transceiver to comprise a code division multiple access transceiver.

26. A wireless handheld device, comprising:

a wireless handheld device housing having disposed therein:

a processor;

a memory to couple to said processor;

a transceiver to couple to said processor; and an antenna to couple to said transceiver, said antenna to comprise:

an antenna body having one or more antenna traces;

an antenna housing to couple to said antenna body, said antenna housing to have a first external surface; and wherein said wireless handheld device housing comprises a second external surface, said first external surface to form a substantially continuous plane with said second external surface;

wherein said antenna body comprises a rigid material, and one end of said antenna body forms a trace contact to contact a metal trace disposed on a printed circuit board.

27. A wireless handheld device, comprising:

a wireless handheld device housing having disposed therein:

a processor;

a memory to couple to said processor;

a transceiver to couple to said processor; and an antenna to couple to said transceiver, said antenna to comprise:

an antenna body having one or more antenna traces;

an antenna housing to couple to said antenna body, said antenna housing to have a first external surface; and wherein said wireless handheld device housing comprises a second external surface, said first external surface to form a substantially continuous plane with said second external surface;

wherein one end of said antenna body forms a trace contact to contact a metal trace disposed on a printed circuit board, said trace contact to slide on said metal trace while remaining in contact with said metal trace when in said extended position, said retracted position, and moving between said positions.

28. An antenna array, comprising:

a first antenna having an antenna body coupled to an antenna housing, said antenna housing having an extended position and a retracted position, said antenna housing to have a first external surface forming a substantially continuous plane with a second external surface for a wireless device housing when in a retracted position; wherein said antenna body comprises a rigid material, and one end of said antenna body forms a trace contact to contact a metal trace disposed on a printed circuit board.

29. An antenna array, comprising:

a first antenna having an antenna body coupled to an antenna housing, said antenna housing having an extended position and a retracted position, said antenna housing to have a first external surface forming a substantially continuous plane with a second external surface for a wireless device housing when in a retracted position; wherein one end of said antenna body forms a trace contact to contact a metal trace disposed on a printed circuit board, said trace contact to slide on said metal trace while remaining in contact with said metal trace when in said extended position, said retracted position, and moving between said positions.

* * * * *